US007293510B1

(12) United States Patent
Siao

(10) Patent No.: US 7,293,510 B1
(45) Date of Patent: Nov. 13, 2007

(54) TELESCOPIC LEG STRUCTURE OF A TABLE

(75) Inventor: Jhen-Siang Wei Siao, Taipei (TW)

(73) Assignee: Chingdar Enterprise Co., Ltd., Taipei (TW)

( * ) Notice: Subject to any disclaimer, the term of this patent is extended or adjusted under 35 U.S.C. 154(b) by 0 days.

(21) Appl. No.: 11/523,520

(22) Filed: Sep. 20, 2006

(51) Int. Cl.
*A47B 9/20* (2006.01)

(52) U.S. Cl. ..... 108/147.19; 248/188.5

(58) Field of Classification Search ..... 108/147.19, 108/144.11, 147.11; 248/188.5, 188.2, 188.8, 248/188.4, 161
See application file for complete search history.

(56) References Cited

U.S. PATENT DOCUMENTS

| | | | | | |
|---|---|---|---|---|---|
| 734,509 | A * | 7/1903 | Caesar | 248/188.5 |
| 2,531,778 | A * | 11/1950 | Merner | 248/188.5 |
| 2,771,261 | A * | 11/1956 | Niggeloh | 248/188.5 |
| 2,806,723 | A * | 9/1957 | Fairclough | 248/188.5 |
| 2,919,941 | A * | 1/1960 | Bohlman et al. | 108/147.19 |
| 2,947,556 | A * | 8/1960 | Wenger | 108/147.19 |
| 4,550,835 | A * | 11/1985 | Lynch | 248/188.5 |
| 4,664,371 | A * | 5/1987 | Viander | 248/188.5 |
| 5,385,323 | A * | 1/1995 | Garelick | 248/188.5 |
| 5,746,152 | A * | 5/1998 | Huse | 248/188.5 |
| 6,092,771 | A * | 7/2000 | Fich | 248/188.5 |
| 6,290,192 | B1 * | 9/2001 | Messerli | 248/188.5 |
| 6,354,231 | B1 * | 3/2002 | Morris | 108/147.19 |
| 6,923,410 | B2 * | 8/2005 | Chang | 248/188.5 |

* cited by examiner

*Primary Examiner*—Jose V. Chen
(74) *Attorney, Agent, or Firm*—Rosenberg, Klein & Lee

(57) ABSTRACT

A telescopic leg of a table consists of an outer tubular member, and an inner tubular member inserted in the outer tubular member; the outer tubular member is coupled to a top of a table, and has a bolt hole; the inner tubular member has a flat pressed side facing the bolt hole of the outer tubular member; a fixing bolt is passed through the bolt hole of the outer tubular member; the fixing bolt will closely touch the inner tubular member at a tail end thereof as well as making the inner tubular member tightly pressed against an inner side of the outer tubular member when it is turned tight; contact area between the fixing bolt and the inner tubular member is planar, and contact area between the inner tubular member and the inner side of the outer tubular member is also planar after the bolt is turned tight.

7 Claims, 4 Drawing Sheets

TELESCOPIC LEG STRUCTURE OF A TABLE

BACKGROUND OF THE INVENTION

1. Field of the Invention

The present invention relates to a telescopic leg of a table, more particularly one, which consists of inner and outer tubular members, and which will be relatively stable without possibility of the inner and the outer tubular members sliding over each other after both are fixed together by means of a bolt.

2. Brief Description of the Prior Art

Tables with telescopic legs are convenient to use, which can be adjusted in height by means of adjusting length of the legs. A currently existing telescopic leg of a table consists of an outer tubular part, an inner tubular part, and a bolt. The inner tubular part is inserted in the outer tubular part. The bolt is passed through the outer tubular part so that it can make the inner tubular part tightly pressed against the outer tubular part for fixing the tubular parts together after the leg is adjusted to a suitable length.

However, because contact between the bolt and the inner tubular part is line-shaped and relatively small, and contact between the inner tubular part and the inner side of the outer tubular part is also line-shaped, the bolt can't fix the inner tubular part to the outer tubular part sufficiently, and in turn the inner tubular part is prone to slide over the outer tubular part, and the table becomes unstable if heavy things are positioned on the table.

SUMMARY OF THE INVENTION

It is a main object of the invention to provide an improvement on a telescopic leg of a table to overcome the above-mentioned problems.

The telescopic leg of the present invention consists of an outer tubular member, and an inner tubular member inserted in the outer tubular member. The outer tubular member is coupled to a top of a table, and has internal protruding portions, and a bolt hole. The inner tubular member has a flat pressed side facing the bolt hole of the outer tubular member, and external protruding portions. A fixing bolt is passed through the bolt hole of the outer tubular member. The fixing bolt will closely touch the inner tubular member at a tail end thereof as well as making the outer protruding portions of the inner tubular member tightly pressed against the internal protruding portions of the outer tubular member when it is turned tight. Contact area between the fixing bolt and the inner tubular member is planar, and contact area between the inner tubular member and the inner side of the outer tubular member is also planar after the bolt is turned tight. Therefore, after the inner and the outer tubular members are fixed together by means of the fixing bolt, the table will be relatively steady without possibility of the inner and the outer tubular members sliding over each other even if heavy things are held on the table.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
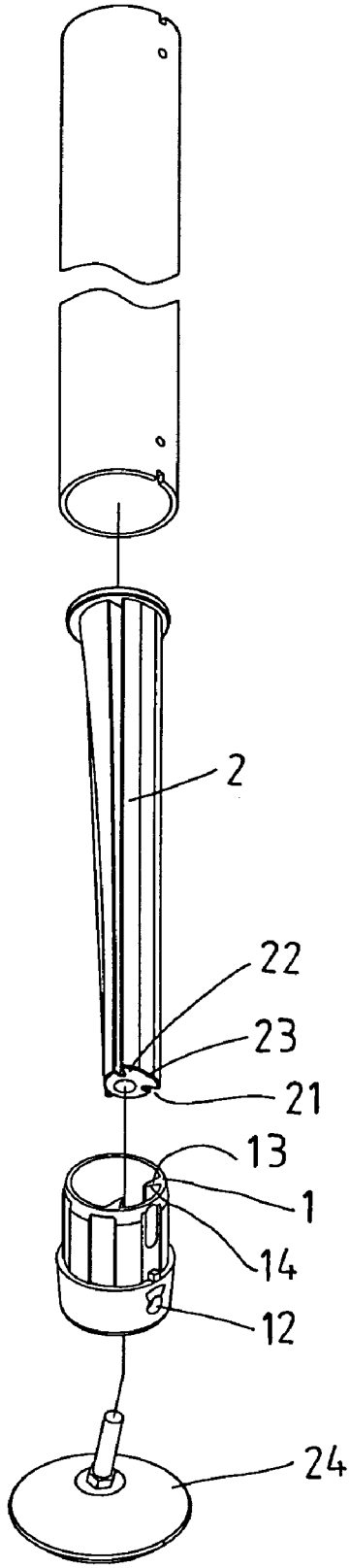
FIG. 1 is a fragmentary exploded perspective view of the present invention.
Figure 2:
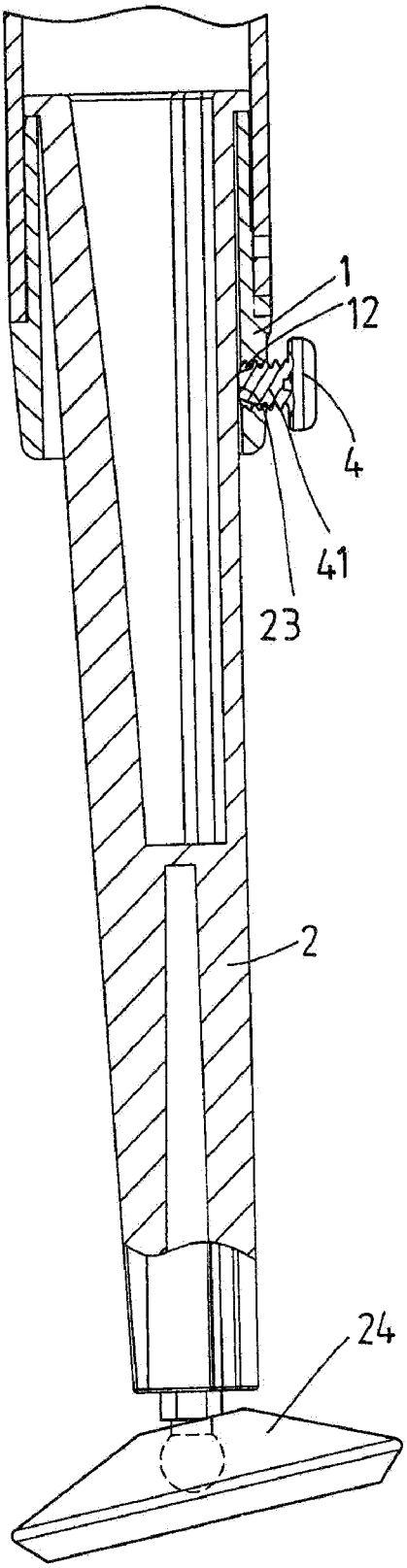
FIG. 2 is a partial sectional view of the present invention.

Referring to FIGS. 1 to 4, a preferred embodiment of a telescopic leg of a table consists of an outer tubular member 1, an inner tubular member 2, a base part 24, and a fixing bolt 4.

The outer tubular member 1 is joined to a transverse connecting tubular part 11 at an upper end thereof, and the transverse connecting tubular part 11 is coupled to a top 3 of the table by means of connecting elements 111. The outer tubular member 1 is cylindrical, and has a bolt hole 12 on a lower end, two first internal opposing protruding portions 13 on two sides of the bolt hole 12, and first fitting spaces 14 between the first internal opposing protruding portions 13 and the bolt hole 12.

The inner tubular member 2 is inserted in the outer tubular member 1. The inner tubular member 2 has two second fitting spaces 21 on an outer side thereof, in which the first internal protruding portions 13 of the outer tubular member 1 is fitted. And, the inner tubular member 2 has two second protruding portions 22 on the outer side, which are adjacent to respective ones of the second fitting spaces 21, and fitted in the first fitting spaces 14 of the outer tubular member 1. Therefore, the inner tubular member 2 can be linearly displaced relative to the outer tubular member 1 to change length of the leg of the table. Furthermore, the inner tubular member 2 has a flat pressed side 23 facing the bolt hole 12 of the outer tubular member 1.

The moving base part 24 is joined to a lower end of the inner tubular member 2, and will move to a certain position according to the shape of the ground the table stands on. And, the fixing bolt 4 is passed through the bolt hole 12 of the outer tubular member 1, and has a pressing portion 41, which will touch the flat pressed side 23 of the inner tubular member 2 closely when the fixing bolt 4 is turned to a tight position to fix the inner tubular member 2 to the outer tubular member 1.

Figure 3:
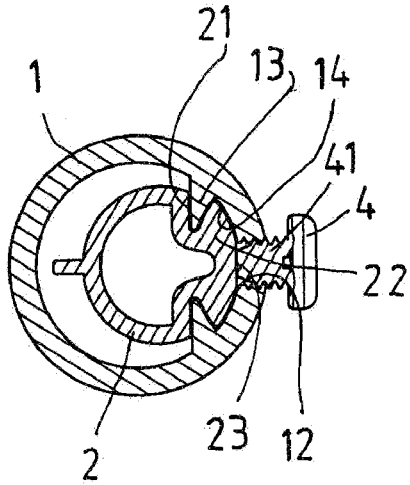
FIG. 3 is a horizontal sectional view of the present invention.
Figure 4:
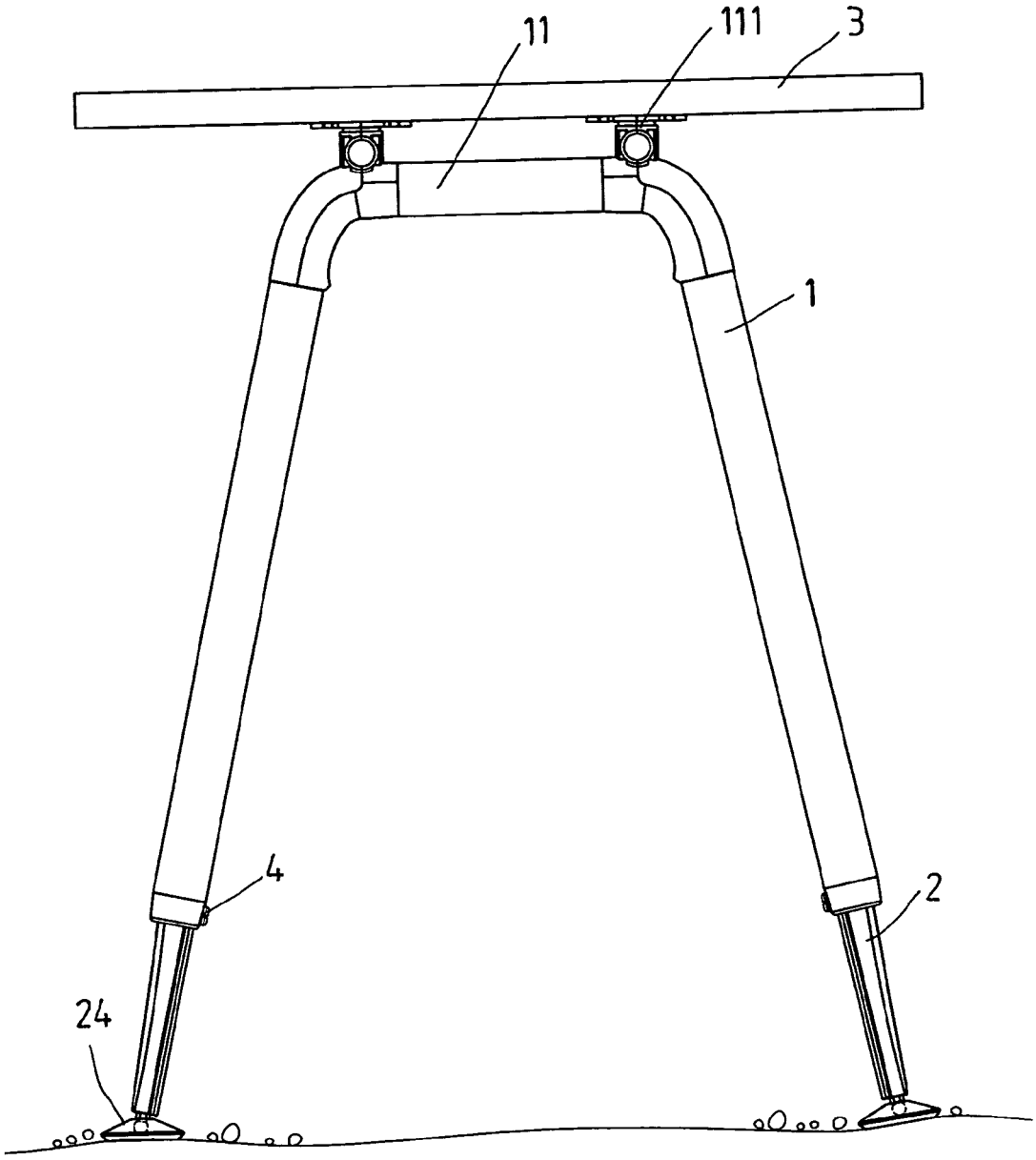
FIG. 4 is a side view of a table with the present invention.
Figure 5:
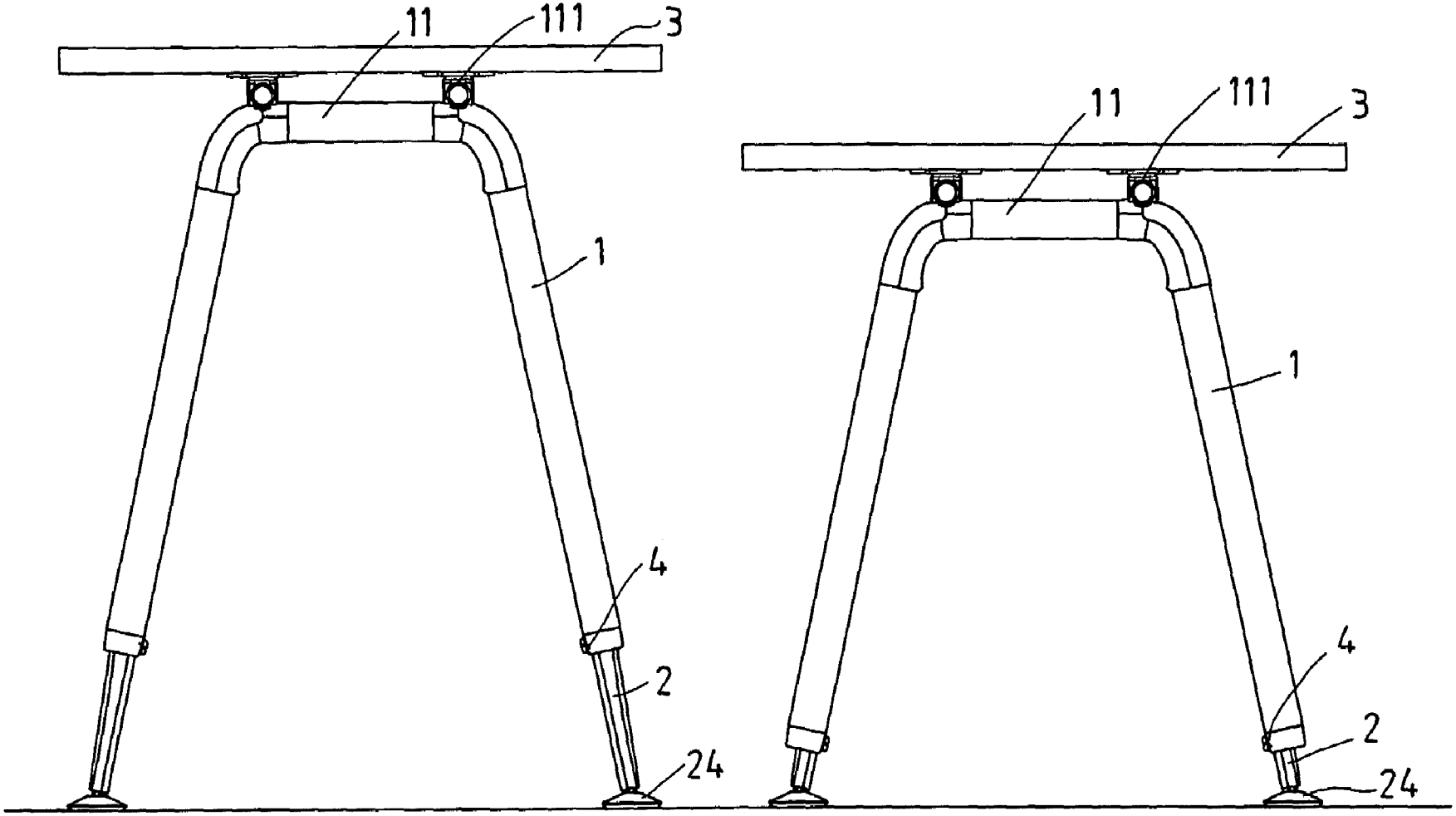
FIG. 5 is a view of a table, taken when the legs are being adjusted in length.

Therefore, the inner tubular member 2 can be linearly displaced relative to the outer tubular member 1 to adjust length of the leg after the fixing bolt 4 is turned loose. After the inner tubular member 2 is moved so as to adjust the leg to a suitable length, the fixing bolt 4 is turned tight with the pressing portion 41 thereof being pressed against and closely touching the pressed side 23 of the inner tubular member 2; thus, the inner tubular member 2 is fixed to the outer tubular member 1 with the second protruding portions 22 of the inner tubular member 2 being tightly pressed against and closely touching the first protruding portions 13 of the outer tubular member 1, as shown in FIG. 3; because the pressed side 23 of the inner tubular member 2 is flat, contact area between the pressing portion 41 of the fixing bolt 4 and the pressed side 23 is planar instead of being linear. In addition, contact area between the second protruding portions 22 of the inner tubular member 2 and the first protruding portions 13 of the outer tubular member 1 is planar instead of being line-shaped. Consequently, the inner tubular member 2 is firmly fixed to the outer tubular member 1.

From the above description, it can be seen that when the fixing bolt is turned tight, the inner tubular member will be firmly fixed, and the present telescopic leg relatively steady because contact area between the fixing bolt and the inner tubular member is planar, and contact area between the second protruding portions and the first protruding portions is also planar and relatively large.

What is claimed is:

1. An improvement on a telescopic leg of a table, comprising an outer tubular member coupled to a top of a table, the outer tubular member having a bolt hole, and two first internal protruding portions formed on opposing sides of the bolt hole with first fitting spaces being disposed between the first internal protruding portions and the bolt hole;

an inner tubular member being inserted in the outer tubular member and being displaceable therein, the inner tubular member having two second fitting spaces on an outer side thereof and in which the first internal protruding portions of the outer tubular member are respectfully fitted, the inner tubular member having two second protruding portions on an outer side thereof respectively adjacent to the second fitting spaces, the second protruding portions being fitted in the first fitting spaces of the outer tubular member; and a fixing bolt threadedly engaged with the bolt hole of the outer tubular member and passed therethrough, the fixing bolt being tightened to engage the inner tubular member and thereby force the second protruding portions to be tightly pressed against the first protruding portions for securement of the inner tubular member in a selected position relative to the outer tubular member.

2. The improvement on a telescopic leg of a table as recited in claim 1, wherein the outer tubular member is cylindrical.

3. The improvement on a telescopic leg of a table as recited in claim 1, wherein the bolt hole is formed on a lower end of the outer tubular member.

4. The improvement on a telescopic leg of a table as recited in claim 1 further having a base part joined to a lower end of the inner tubular member.

5. The improvement on a telescopic leg of a table as recited in claim 1, wherein the inner tubular member has a flat pressed side facing the bolt hole of the outer tubular member.

6. The improvement on a telescopic leg of a table as recited in claim 1, wherein the outer tubular member is joined to a transverse connecting tubular part at an upper end thereof.

7. The improvement on a telescopic leg of a table as recited in claim 6, wherein the transverse connecting tubular part is coupled to the top of the table by means of connecting elements.

* * * * *